US012280316B2

(12) United States Patent
Hernes

(10) Patent No.: US 12,280,316 B2
(45) Date of Patent: Apr. 22, 2025

(54) CUSTOMIZABLE SHAPE GAME SCORING BOARD DEVICE

(71) Applicant: Eric L. Hernes, Sioux Falls, SD (US)

(72) Inventor: Eric L. Hernes, Sioux Falls, SD (US)

( * ) Notice: Subject to any disclaimer, the term of this patent is extended or adjusted under 35 U.S.C. 154(b) by 577 days.

(21) Appl. No.: 17/543,817

(22) Filed: Dec. 7, 2021

(65) Prior Publication Data

US 2023/0173376 A1 Jun. 8, 2023

(51) Int. Cl.

*A63F 3/00* (2006.01)
*A63F 1/04* (2006.01)
*A63F 1/18* (2006.01)

(52) U.S. Cl.

CPC ..... *A63F 3/00006* (2013.01); *A63F 1/04* (2013.01); *A63F 1/18* (2013.01); *A63F 3/00261* (2013.01); *A63F 3/00574* (2013.01); *A63F 2003/00391* (2013.01); *A63F 2003/00583* (2013.01)

(58) Field of Classification Search

CPC ..... A63F 3/00006; A63F 3/00173; A63F 3/0023; A63F 3/00261; A63F 3/00574; A63F 2003/00359; A63F 2003/00362; A63F 2003/00365; A63F 2003/00369; A63F 2003/00372; A63F 2003/00375; A63F 2003/00378; A63F 2003/00381; A63F 2003/00384; A63F 2003/00388; A63F 2003/00391; A63F 2003/00583

USPC ..... 273/239, 275, 276, 281, 283, 284, 287

See application file for complete search history.

(56) References Cited

U.S. PATENT DOCUMENTS 2,108,527 A 8/1936 Cudmore
2,432,167 A * 12/1947 Manuel ..... A63F 1/18 235/90
2,434,495 A 4/1951 Holton
2,646,221 A * 7/1953 Landers ..... A63F 1/06 235/90
3,347,460 A * 10/1967 Dickson ..... A63F 1/06 273/284
3,731,934 A * 5/1973 Shoptaugh ..... A63F 3/02 273/284
4,466,615 A * 8/1984 Yaeger ..... A63F 9/20 273/157 R
4,504,243 A * 3/1985 Barlow ..... A63F 3/00634 446/447
4,526,376 A * 7/1985 Rosenwinkel ..... A63F 3/00097 273/284
4,696,476 A * 9/1987 Eplett ..... A63F 3/00214 273/287
4,953,786 A * 9/1990 Arsenault ..... A63H 18/02 238/10 F (Continued)

*Primary Examiner* — Joseph B Baldori

(57) ABSTRACT

A customizable shape game scoring board device includes a plurality of board segments including an end segment and track segments. A top surface of each track segment has a plurality of track peg holes. The track peg holes in each track segment are arranged into a plurality of tracks extending across a top surface of the track segment. Track connectors are positioned on the connection faces of an the track segments. The track segments are arrangeable to define a series of joined track segments forming a plurality of tracks extending from an initial one of the track segments to a terminal one of the track segments. An end peg hole extends into an upper face of the end segment. An end connector is engageable to the track connector on a free one of the connection faces of the terminal segment.

3 Claims, 7 Drawing Sheets

(56) References Cited

U.S. PATENT DOCUMENTS

| | | | | | |
|---|---|---|---|---|---|
| 4,990,117 | A * | 2/1991 | Yonezawa | A63H 18/10 | 446/444 |
| 5,028,765 | A * | 7/1991 | Hull | A63F 3/00006 | 235/90 |
| 5,188,364 | A * | 2/1993 | Falzarano | A63F 3/00006 | 273/287 |
| 5,407,206 | A * | 4/1995 | Cohen | A63F 9/0093 | 235/90 |
| 5,952,637 | A | 9/1999 | Strunk | | |
| 5,971,830 | A * | 10/1999 | Tobin | A63F 9/0078 | 446/259 |
| 8,246,049 | B1 | 8/2012 | Martens | | |
| 8,282,438 | B2 * | 10/2012 | Tamulewicz | A63H 33/26 | 446/129 |
| 9,149,730 | B1 * | 10/2015 | Hauser | A63H 3/50 | |
| 10,300,367 | B1 * | 5/2019 | Douglas, Jr. | A63F 3/00261 | |
| 10,357,707 | B1 * | 7/2019 | Aristizabal | A63F 3/00176 | |
| 10,758,834 | B2 * | 9/2020 | Klein | A63H 33/42 | |
| 11,198,054 | B1 * | 12/2021 | Holtey | A63F 3/00176 | |
| 11,198,057 | B2 * | 12/2021 | Bubnjic | A63H 1/00 | |
| 2005/0017449 | A1 * | 1/2005 | Belcher | A63F 3/00075 | 273/287 |
| 2007/0266911 | A1 * | 11/2007 | Lee | A63F 9/1044 | 108/60 |
| 2016/0317907 | A1 * | 11/2016 | Vandoren | A63F 3/00261 | |
| 2018/0353843 | A1 * | 12/2018 | Brown | A63F 3/0023 | |
| 2019/0076729 | A1 * | 3/2019 | Olson | A63F 3/00006 | |
| 2023/0277914 | A1 * | 9/2023 | Foster | A63F 1/00 | 273/258 |

* cited by examiner

CUSTOMIZABLE SHAPE GAME SCORING BOARD DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to game boards and more particularly pertains to a new game scoring board for assembling a scoring board of a variable and configurable shape.

(2) Description of Related Art Including Information Disclosed Under 37 CFR 1.97 and 1.98

The prior art relates to game boards. Game boards conventionally have been provided in a fixed shape. Some game boards in prior art are segmented but provide for specific construction such that the shape of the game board is not adjustable.

BRIEF SUMMARY OF THE INVENTION

An embodiment of the disclosure meets the needs presented above by generally comprising a plurality of board segments including an end segment and track segments. A top surface of each track segment has a plurality of track peg holes. The track peg holes in each track segment are arranged into a plurality of tracks extending across a top surface of the track segment. Track connectors are positioned on the connection faces of an the track segments. The track segments are arrangeable to define a series of joined track segments forming a plurality of tracks extending from an initial one of the track segments to a terminal one of the track segments. An end peg hole extends into an upper face of the end segment. An end connector is engageable to the track connector on a free one of the connection faces of the terminal segment.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
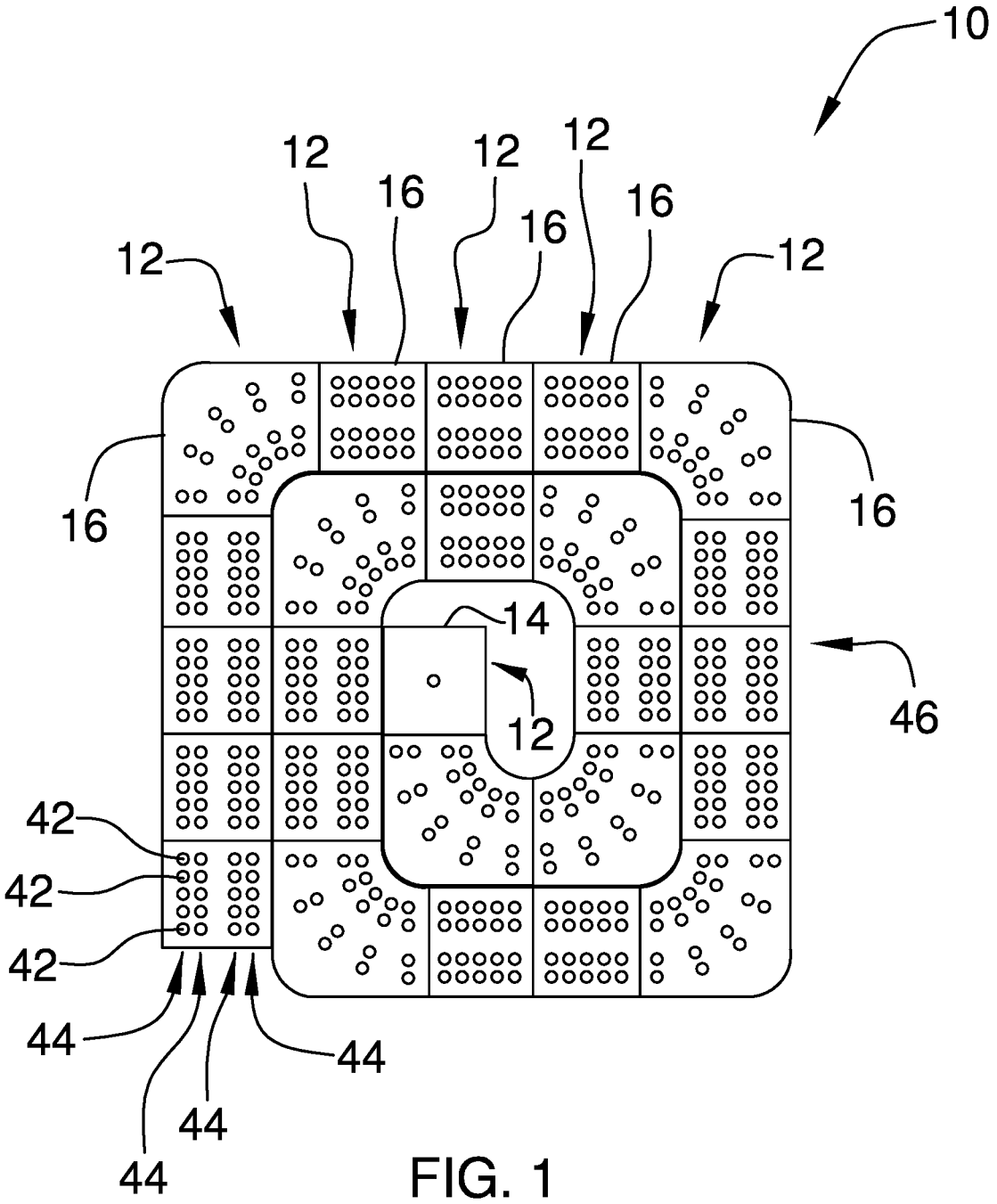
FIG. 1 is a top view of a customizable shape game scoring board device according to an embodiment of the disclosure.
Figure 2:
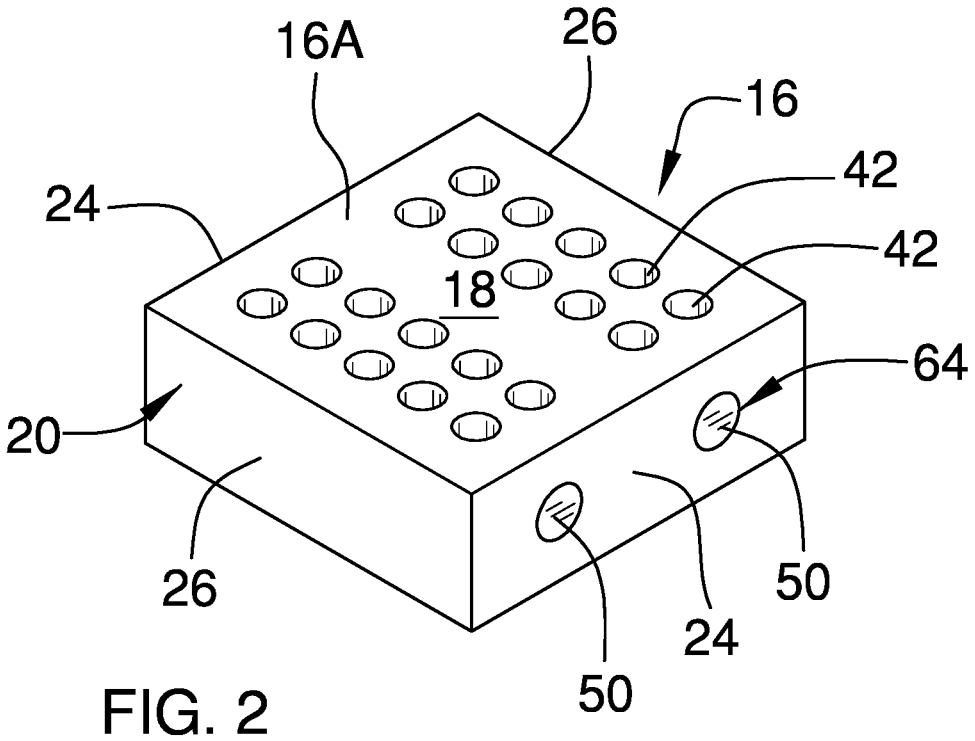
FIG. 2 is a perspective view of a straight track segment of an embodiment of the disclosure.
Figure 3:
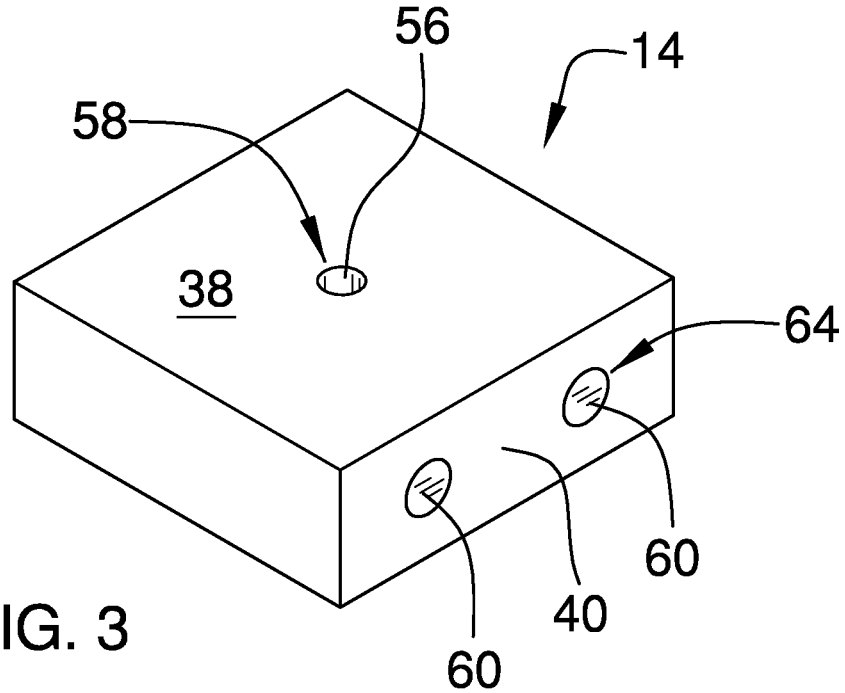
FIG. 3 is a perspective view of an end segment of an embodiment of the disclosure.
Figure 4:
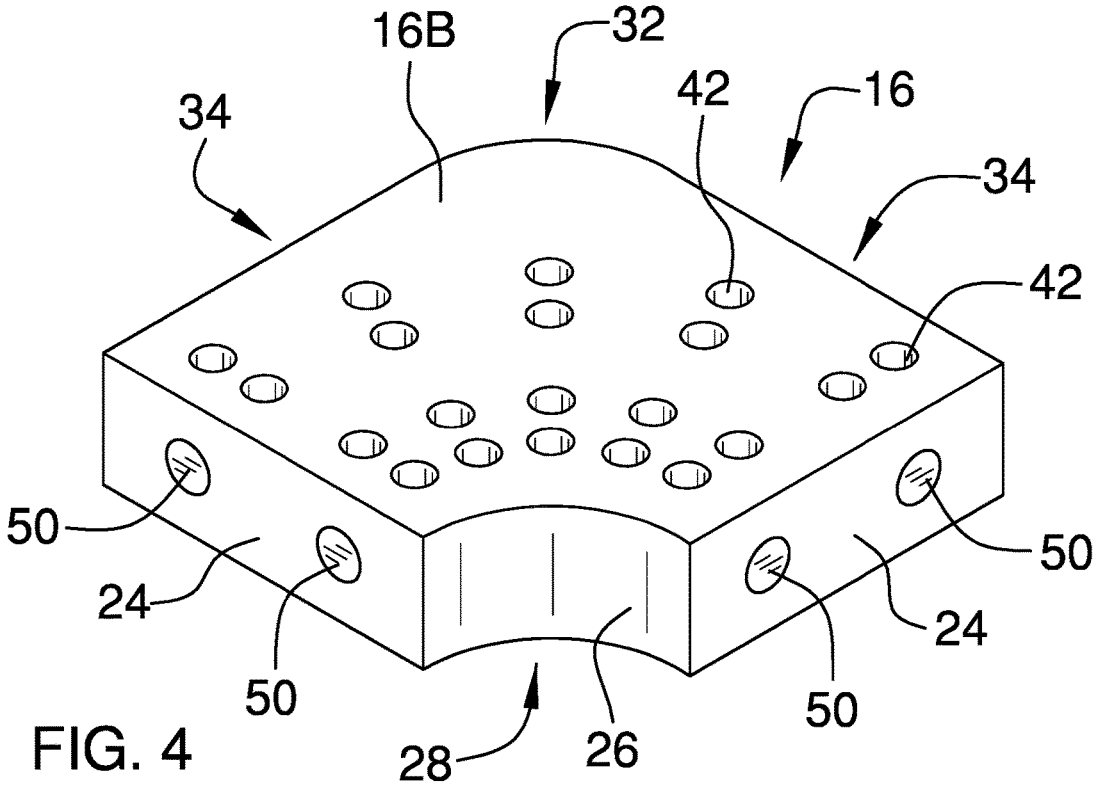
FIG. 4 is a perspective view of a corner track segment of an embodiment of the disclosure.
Figure 5:
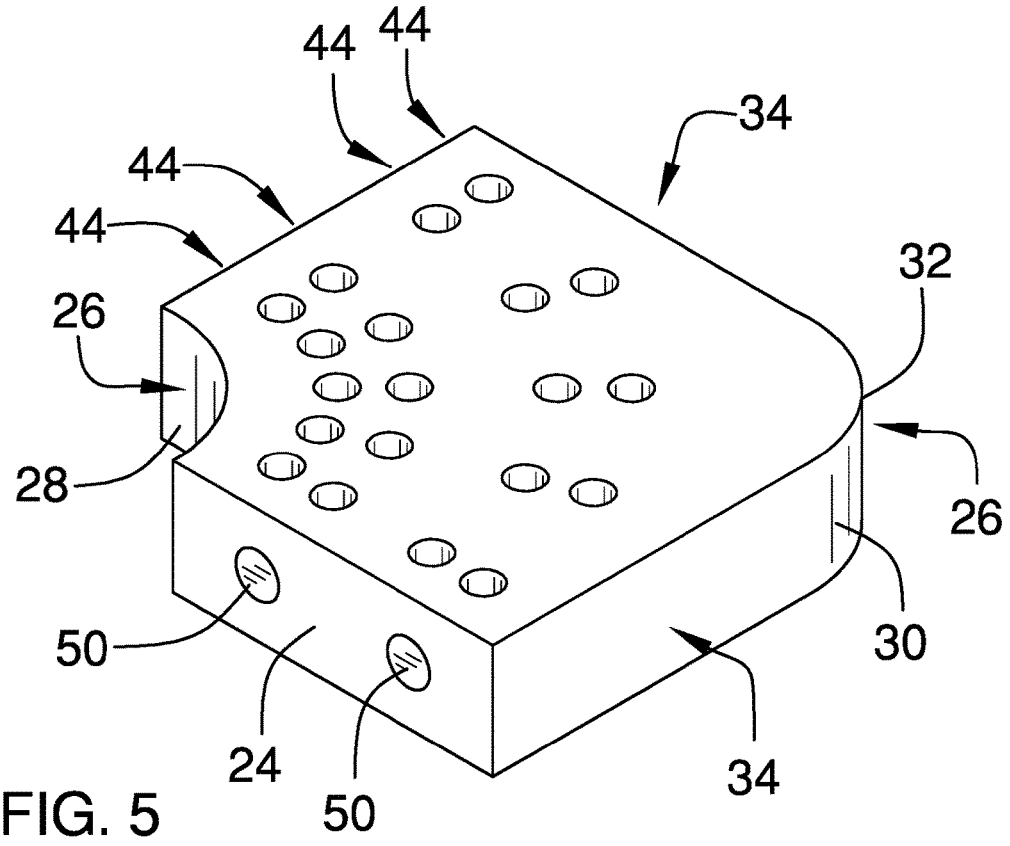
FIG. 5 is a perspective view of a corner track segment of an embodiment of the disclosure.
Figure 6:
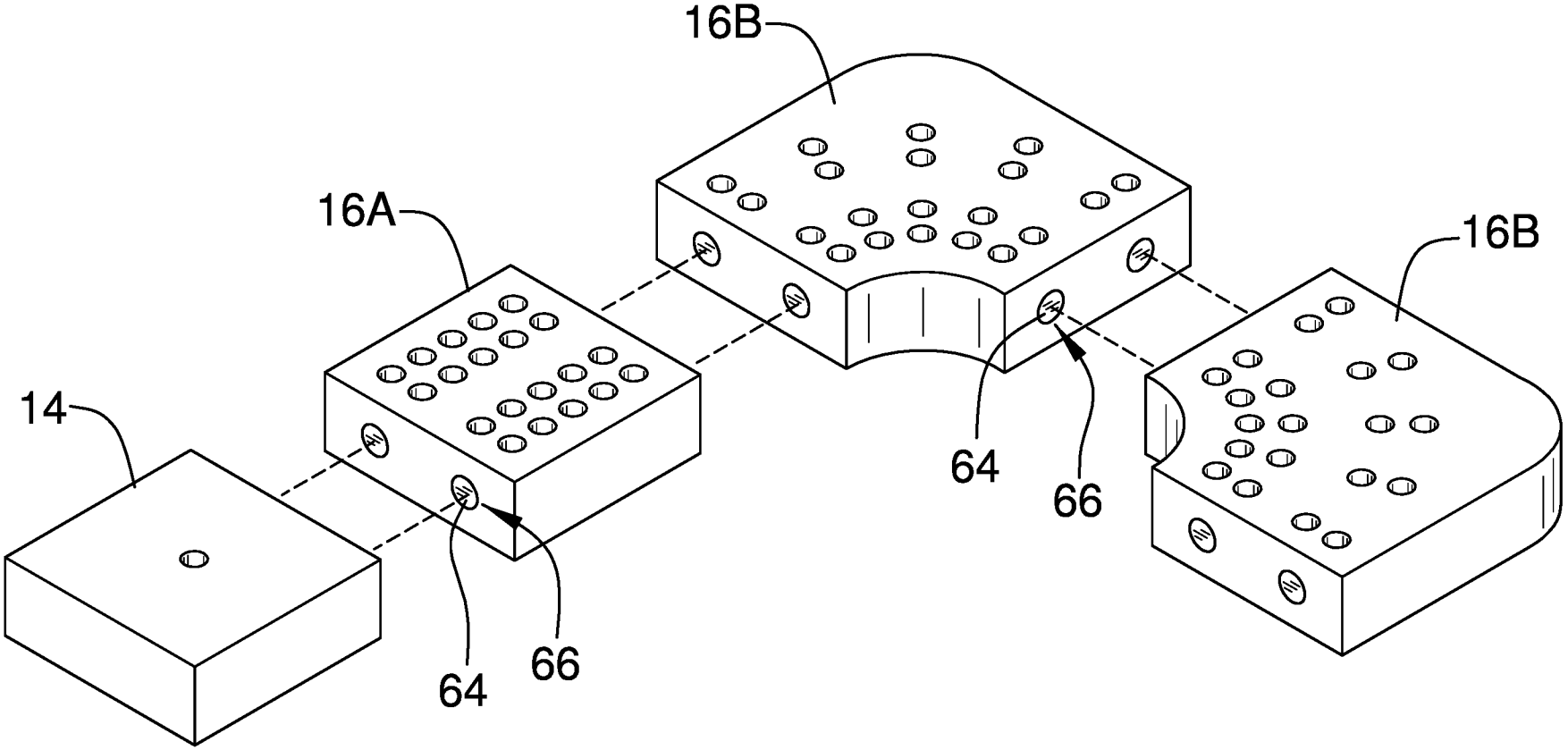
FIG. 6 is an exploded perspective view of an embodiment of the disclosure.
Figure 7:
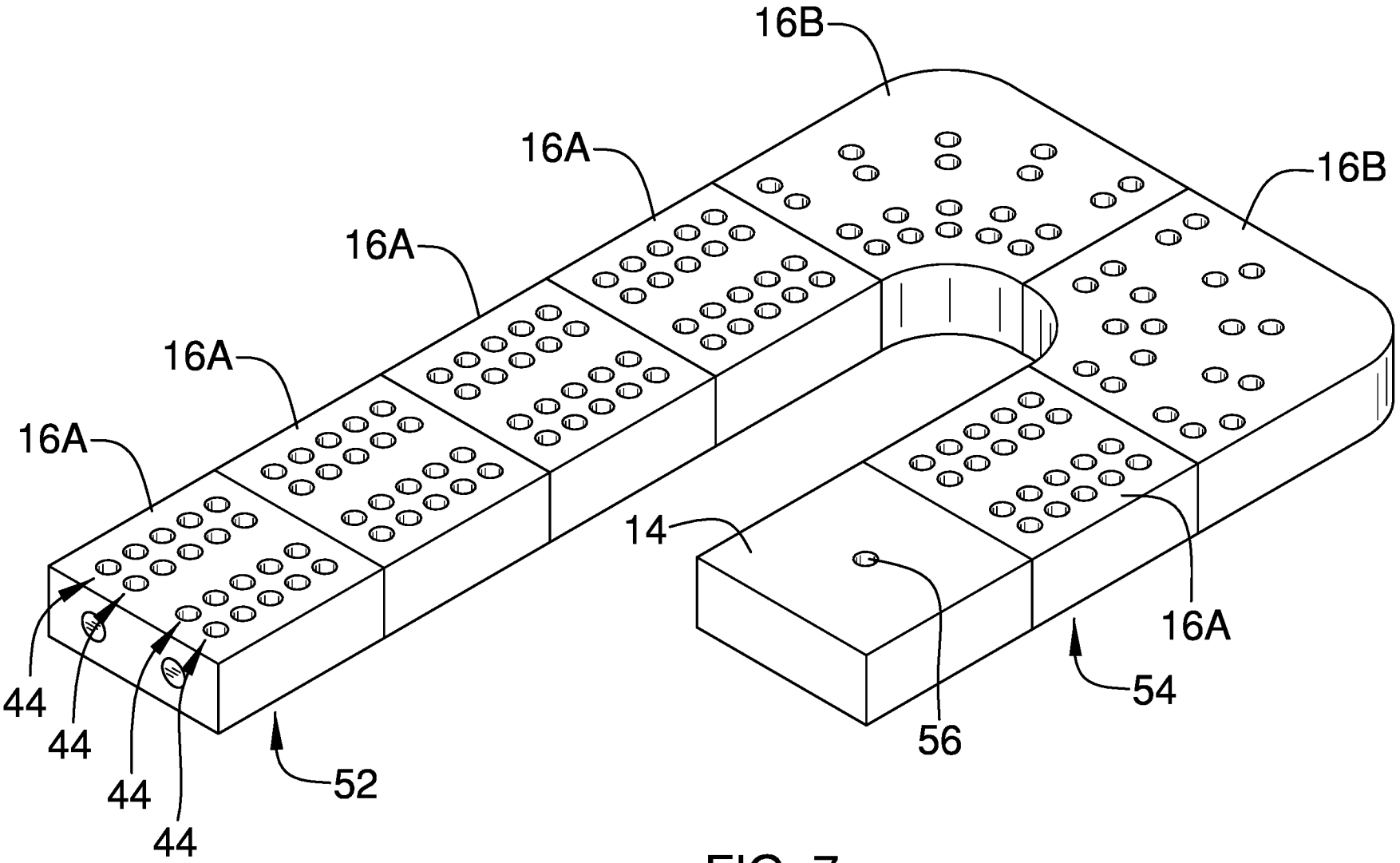
FIG. 7 is a perspective view of an embodiment of the disclosure.
Figure 8:
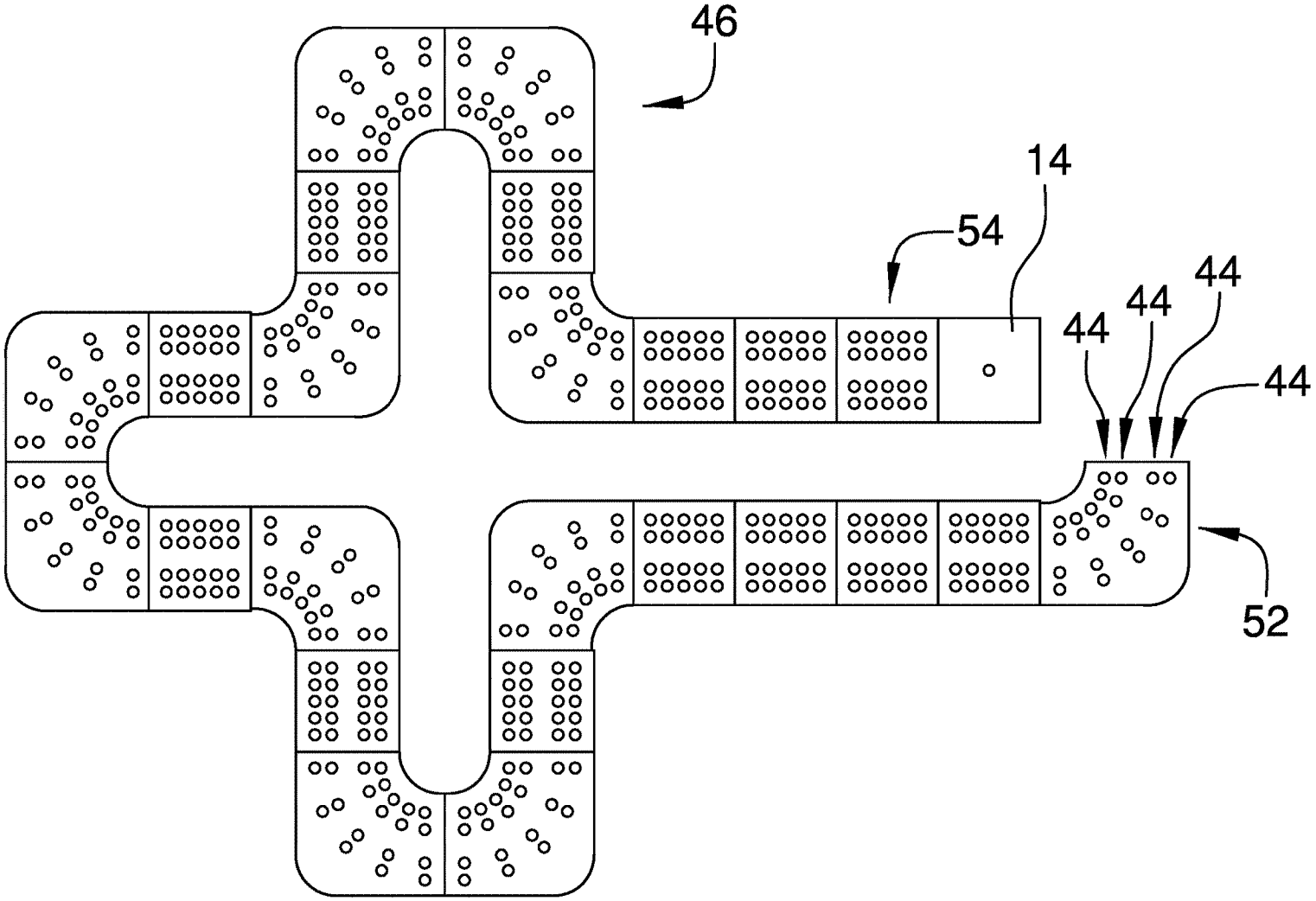
FIG. 8 is a top view of an embodiment of the disclosure.

With reference now to the drawings, and in particular to FIGS. 1 through 9 thereof, a new game board embodying the principles and concepts of an embodiment of the disclosure and generally designated by the reference numeral 10 will be described.

As best illustrated in FIGS. 1 through 9, the customizable shape game scoring board device 10 generally comprises a plurality of board segments 12. The plurality of board segments 12 includes an end segment 14 and a plurality of track segments 16. Each track segment 16 has a respective top surface 18 and a respective peripheral wall 20 extending downwardly from a peripheral edge 22 of the top surface 18. The peripheral wall 20 of each track segment 16 has a pair of connection faces 24 and a pair of lateral faces 26 extending between the connection faces 24. It is specifically contemplated that the lateral faces 26 may be a single planar surface or alternatively incorporate curves or multiple facets to produce track segments 16 having different geometric or non-geometric shapes. Generally, the connection faces 24 of all track segments 16 have an equal width. The track segments 16 include a plurality of straight track segments 16A and a plurality of corner track segments 16B. The top surface 18 of each straight track segment 16A is square and each straight track segment 16A has an equal size. The pair of lateral faces 26 of each straight track segment 16A is straight and parallel to each other. The pair of lateral faces 26 of each corner track segment 16B includes an inner face 28 and an outer face 30. The inner face 28 is curved along a full length of the inner face 28. The outer face 30 has a curved medial section 32 positioned between straight outer sections 34. The straight outer sections 34 are perpendicular to each other. The inner face 28 is complementary to the curved medial section 32 wherein the curved medial section 32 is positionable to nest against the inner face 28. The end segment 14 has an upper face 38 and a lateral surface 40 extending perpendicularly from the upper face 38. The upper face 38 of the end segment 14 is square and of equal size to the top surface 18 of each straight track segment 16A.

The top surface 18 of each track segment 16 has a plurality of track peg holes 42 extending downwardly into the track segment 16. The track peg holes 42 in each track segment 16 are arranged into a plurality of tracks 44 extending across the top surface 18 of the track segment 16. The tracks 44 in each track segment 16 extend between the connection faces 24. Each track segment 16 has a total of twenty track peg holes 42 which are arranged into four tracks 44, each track 44 having five track peg holes 42. The plurality of track segments 16 may be 24 track segments 16 to produce game scoring consistent with a conventional cribbage board having a total of 120 track peg holes along each track 44. However, the total number of track segments 16 used to form a peg board 46 can be varied to produce shorter or longer tracks 44 if desired to allow for use of the device 10 for tracking scores of multiple players for any game.

Each of a plurality of track connectors 50 is positioned on an associated one of the connection faces 26 of an associated one of the track segments 16. The tracks 44 in adjacently positioned track segments 16 are aligned with each other when the connection faces 24 of the adjacently positioned track segments 16 are coupled together by the track connectors 50 in abutting connection faces 24 of the adjacently positioned track segments 16. Each track connector 50 is positioned to engage the track connector 50 on an adjacently positioned one of the track segments 16 to define a pair of joined track connectors 50 and joined track segments 16. The track segments 16 are arrangeable to define a series of joined track segments 16 forming a plurality of tracks 44 extending from an initial one 52 of the track segments 16 to a terminal one 54 of the track segments 16. Each connection face 24 may have a pair of the track connectors 50. The pair of track connectors 50 are equally spaced laterally from a centerline of the connection face 24.

An end peg hole 56 extends into the upper face 38 of the end segment 14. The end peg hole 56 is positioned at a center 58 of the upper face 38 of the end segment 14. The tracks 44 on the track segments 16 may be offset from a centerline extending between the connection faces 24 of the track segments 16. An end connector 60 is positioned on the lateral surface 40 of the end segment 14. The end connector 60 is engageable to the track connector 50 on a free one of the connection faces 24 of the terminal segment 54. The end connector 60 may be one of a pair of end connectors 60 positioned on the lateral surface 40 of the end segment 14 when pairs of track connectors 50 are used to connect the track segments 16. Each of the plurality of track connectors 50 and the end connector 60 is a magnet 64 but other disengageable couplers may be used in the alternative. Each magnet 64 has a planar face 66. The planar face 66 of each magnet 64 positioned on a connection face 24 of a track segment 16 is positioned coplanar with the connection face 24 to prevent gaps between joined track segments 16. The planar face 66 of the magnet 64 positioned on the lateral surface 40 of the end segment 14 is coplanar with the lateral surface 40 of the end segment 14.

Figure 9:
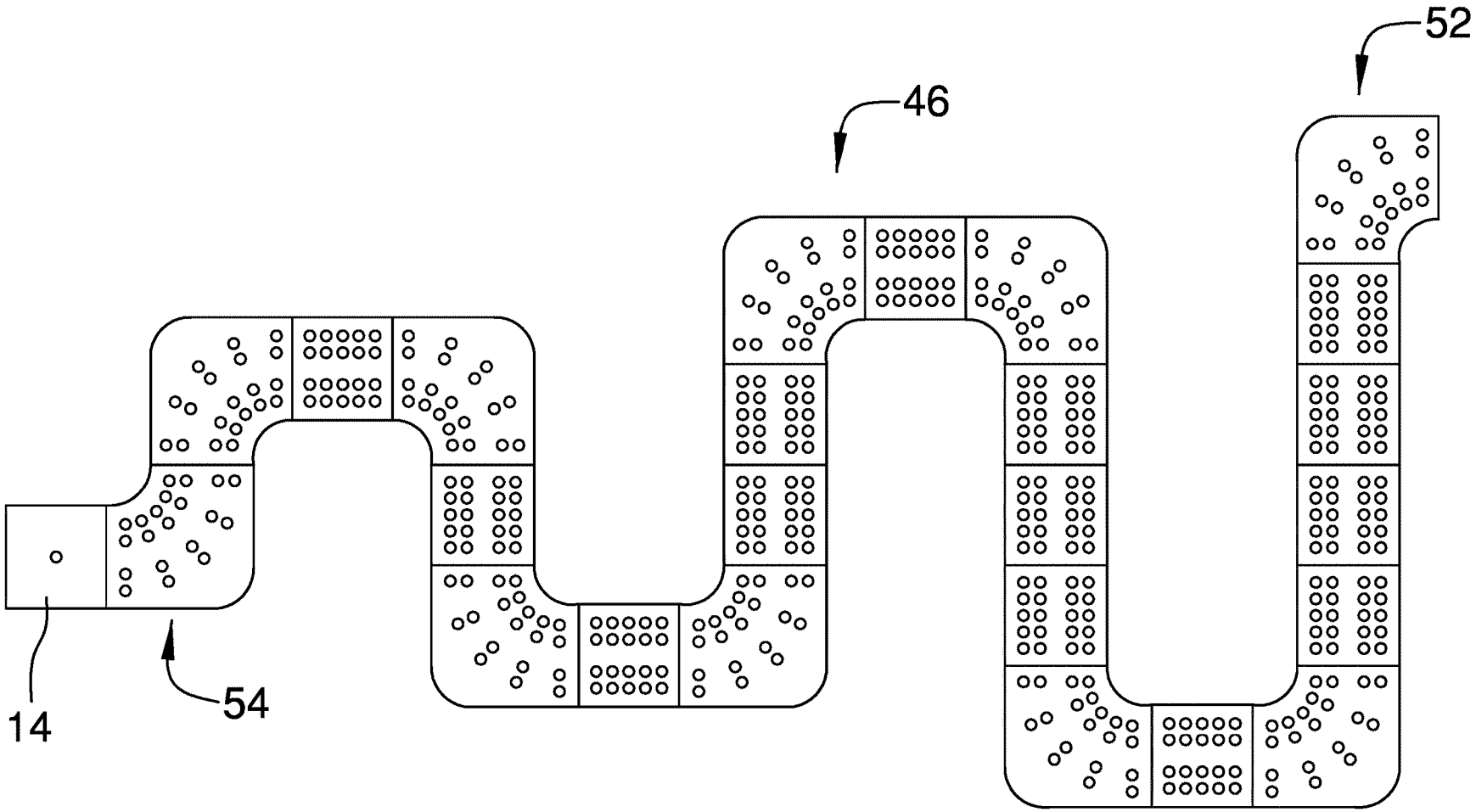
FIG. 9 is a top view of an embodiment of the disclosure.

In use, the track segments 16 are arranged and interconnected into a shape to form the peg board which may be used for score tracking consistent with the conventional rules for playing cribbage or another game using similar scoring. While a conventional peg board 46 would have 120 track peg holes 42 and a single end peg hole 56, the number of track segments 16, and types of track segments 16 including straight track segments 16A and corner track segments 16B, is variable to allow for construction of shorter or longer total tracks 44 and customization of the shape of the total peg board 46 when all desired track segments 16 and the end segment 14 are assembled. Examples can be seen in the drawings to include use of 8 corner track segments 16B and 16 straight track segments 16A (FIG. 1), 11 corner track segments 16B and 13 straight track segments 16A (FIG. 8), and 10 corner track segments 16B and 14 straight track segments 16A (FIG. 9).

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A customizable shape game scoring board device comprising:

a plurality of board segments, said plurality of board segments including an end segment and a plurality of track segments, said plurality of track segments being 24 track segments, each track segment having a top surface and a peripheral wall extending downwardly from a peripheral edge of said top surface, said peripheral wall of each track segment having a pair of connection faces and a pair of lateral faces extending between said connection faces, said connection faces of all track segments having an equal width, said track segments including a plurality of straight track segments and a plurality of corner track segments, said top surface of each straight track segment being square, said pair of lateral faces of each straight track segment being straight and parallel to each other, said pair of lateral faces of each corner track segment including an inner face and an outer face, said inner face being curved along a full length of said inner face, said outer face having a curved medial section positioned between straight outer sections, said straight outer sections being perpendicular to each other, said inner face being complementary to said curved medial section wherein said curved medial section is positionable to nest against said inner face, said end segment having an upper face and a lateral surface extending perpendicularly from said upper face, said upper face of said end segment being square;

said top surface of each track segment having a plurality of track peg holes extending downwardly into said track segment, said track peg holes in each track segment being arranged into a plurality of tracks extending across said top surface of said track segment, said tracks in each track segment extending between said connection faces, each track segment having twenty track peg holes arranged into four tracks each having five track peg holes;

a plurality of track connectors, each track connector being positioned on and associated one of said connection faces of an associated one of said track segments, said tracks in adjacently positioned track segments being aligned with each other when said connection faces of said adjacently positioned track segments are coupled together by said track connectors in abutting connection faces of said adjacently positioned track segments, each track connector being positioned to engage said track connector on an adjacently positioned one of said track segments to define a pair of joined track connectors and joined track segments, said track segments being arrangeable to define a series of joined track segments forming a plurality of tracks extending from an initial one of said track segments to a terminal one of said track segments, each connection face having a pair of said track connectors, said pair of track connectors being equally spaced laterally from a centerline of said connection face;

an end peg hole extending into said upper face of said end segment, said end peg hole being positioned at a center of said upper face of said end segment;

an end connector positioned on said lateral surface of said end segment, said end connector being engageable to said track connector on a free one of said connection faces of said terminal segment, said end connector being one of a pair of end connectors positioned on said lateral surface of said end segment; and each of said plurality of track connectors and said end connector being a magnet, each magnet having a planar face, said planar face of each magnet positioned on a connection face of a track segment being positioned coplanar with said connection face, said planar face of said magnet positioned on said lateral surface of said end segment being coplanar with said lateral surface of said end segment.

2. The customizable shape game scoring board device of claim 1, further comprising said plurality of track segments being 24 track segments including 16 straight track segments and 8 corner track segments.

3. The customizable shape game scoring board device of claim 1, further comprising said plurality of track segments being 24 track segments including 13 straight track segments and 11 corner track segments.

* * * * *